US010213639B2

(12) United States Patent
Giannelli et al.

(10) Patent No.: US 10,213,639 B2
(45) **Date of Patent: *Feb. 26, 2019**

(54) ADAPTIVE RESISTANCE EXERTING EXERCISE APPARATUS

(71) Applicant: Cybex International, Inc., Medway, MA (US)

(72) Inventors: Raymond Giannelli, Franklin, MA (US); Mark Buontempo, Millville, MA (US)

(73) Assignee: Cybex International, Inc., Medway, IL (US)

( * ) Notice: Subject to any disclaimer, the term of this patent is extended or adjusted under 35 U.S.C. 154(b) by 24 days.

This patent is subject to a terminal disclaimer.

(21) Appl. No.: 15/423,033

(22) Filed: Feb. 2, 2017

(65) Prior Publication Data

US 2017/0157449 A1 Jun. 8, 2017

Related U.S. Application Data

(63) Continuation of application No. 14/982,678, filed on Dec. 29, 2015, now Pat. No. 9,656,116, which is a (Continued)

(51) Int. Cl.
*A63B 21/00* (2006.01)
*A63B 21/008* (2006.01)
(Continued)

(52) U.S. Cl.
CPC ..... *A63B 21/156* (2013.01); *A63B 21/0051* (2013.01); *A63B 21/00058* (2013.01); (Continued)

(58) Field of Classification Search
CPC . A63B 21/156; A63B 21/063; A63B 21/0628; A63B 21/0051; A63B 21/00058; (Continued)

(56) References Cited

U.S. PATENT DOCUMENTS 8,585,554 B2 * 11/2013 Shavit ..... A63B 21/0058 482/121
2010/0105530 A1 4/2010 Inaizumi
(Continued)

FOREIGN PATENT DOCUMENTS

EP 2644230 A1 2/2013
FR 2.174.414 9/1973
(Continued)

OTHER PUBLICATIONS

Int'l. Search Report and Written Opinion dated Jan. 5, 2015 in Int'l. Appln. No. PCT/US2014/056206.
(Continued)

*Primary Examiner* — Megan Anderson
(74) *Attorney, Agent, or Firm* — Andrus Intellectual Property Law, LLP

(57) ABSTRACT

An exercise apparatus comprising a weight stack, a flexible elongated cable having a downstream portion that is interconnected to a user selectable number of the one or more individual bodies of weight and to a second resistance device, a manually movable actuating device interconnected to a proximal end of the cable, a downstream portion of the cable being interconnected to the one or more individual bodies of weight and to the second resistance device in an arrangement that pulls on both the one or more individual bodies of weight and the second resistance device.

9 Claims, 12 Drawing Sheets

Related U.S. Application Data continuation of application No. PCT/US2014/056206, filed on Sep. 18, 2014, and application No. 14/982,678, Dec. 29, 2015, which is a continuation-in-part of application No. PCT/US2014/055124, filed on Sep. 11, 2014.

(60) Provisional application No. 61/879,334, filed on Sep. 18, 2013.

(51) Int. Cl.

| | |
|---|---|
| ***A63B 21/02*** | (2006.01) |
| ***A63B 21/055*** | (2006.01) |
| ***A63B 23/035*** | (2006.01) |
| ***A63B 21/062*** | (2006.01) |
| ***A63B 21/005*** | (2006.01) |

(52) U.S. Cl.

CPC ..... *A63B 21/0088* (2013.01); *A63B 21/023* (2013.01); *A63B 21/055* (2013.01); *A63B 21/063* (2015.10); *A63B 21/0628* (2015.10); *A63B 21/4035* (2015.10); *A63B 23/0355* (2013.01); *A63B 23/03541* (2013.01)

(58) Field of Classification Search

CPC ..... A63B 21/055; A63B 23/0355; A63B 23/03541

See application file for complete search history.

(56) References Cited

U.S. PATENT DOCUMENTS

| | | | |
|---|---|---|---|
| 2010/0204021 | A1 | 8/2010 | Giannelli |
| 2011/0082015 | A1 | 4/2011 | Dreissigacker |
| 2013/0109543 | A1 | 2/2013 | Reyes |
| 2013/0109544 | A1 | 2/2013 | Reyes |

FOREIGN PATENT DOCUMENTS

| | | | |
|---|---|---|---|
| WO | 2001066195 | A2 | 9/2001 |
| WO | 2012075404 | A2 | 6/2012 |

OTHER PUBLICATIONS

Preliminary Report on Patentability dated Sep. 13, 2016 in Int'l. Appln. No. PCT/US2015/019837.

Written Opinion of the ISA in Int'l. Appln. No. PCT/US2015/019866.

Canadian Office Action dated 2017 Nov. 2, 2017 in Appln No. 2,924,350; Cybex International, Inc.

* cited by examiner

ADAPTIVE RESISTANCE EXERTING EXERCISE APPARATUS

RELATED APPLICATIONS

This application is a continuation of and claims the benefit of priority to U.S. application Ser. No. 14/982,678 filed Dec. 29, 2015 which in turn is a continuation application of PCT/US2014/056206 filed Sep. 18, 2014 which claims the benefit of priority to U.S. provisional patent application Ser. No. 61/879,334 filed Sep. 18, 2013 the disclosures of all of which are incorporated herein by reference in their entirety as if fully set forth herein.

This application incorporates by reference as if fully set forth herein in their entirety the disclosures of all of the following: U.S. Pat. No. 8,025,609, U.S. Pat. No. 7,278,955, U.S. Pat. No. 8,062,185, U.S. Pat. No. 8,057,363, U.S. Pat. No. 8,454,478, U.S. Pat. No. 8,827,877, U.S. Application Publication No. 20090176625 and U.S. Pat. No. 8,708,872, U.S. Pat. No. 8,057,367 and U.S. Patent Publication No. 2003/0166439, U.S. Patent Publication No. 2013/0040787, U.S. Patent Publication 20140005009 and U.S. Patent Publication No. 20030166439.

FIELD OF THE INVENTION

The present invention relates to physical exercise machines and more particularly to an exercise apparatus that enables users to perform a weight lifting or other incremental weight movement exercise.

BACKGROUND OF THE INVENTION

Exercise machines for lifting discrete amounts of non-varying weight are known and used for use in a variety of machines. The degree of resistance to performance of the exercise varies incrementally and linearly with the degree of force or speed exerted by the user.

SUMMARY OF THE INVENTION

In accordance with the invention there is provided an exercise apparatus comprising:

a weight stack comprised of one or more individual bodies of discrete non-variable weight, a flexible elongated cable having a proximal end and a downstream portion extending downstream from the proximal end of the cable, the downstream portion of the cable mechanism being interconnected to a user selectable number of one or more individual bodies of weight that exert a first resistance and to a second resistance device that exerts a second resistance, a manually movable actuating device interconnected to the proximal end of the cable, the cable being arranged such that the actuating device is manually engageable and movable by a user to exert an exercise speed, velocity, force, energy or power on the proximal end of the cable that extends to the downstream portion of the cable, the downstream portion of the cable being directly connected both to the one or more individual bodies of weight and to the second resistance device in an arrangement that pulls in one direction on the one or more individual bodies of discrete, non-variable weight and pulls against the second resistance device, the second resistance device exerting a degree of second resistance to movement of the actuating device that varies non-linearly with the degree of exercise speed, velocity, force, energy or power exerted on the actuating device or on the second resistance device.

The apparatus is typically adapted such that movement of the actuating device by the user effects mechanical movement of a movable component of the second resistance device that increases the degree of the second resistance non-linearly with the degree of increase in speed or velocity of movement exerted on the movable component of the second resistance device or the actuating device.

The degree of the second resistance preferably varies geometrically or exponentially with the degree of exercise speed, velocity, force, energy or power exerted on the actuating device or the second resistance device.

The second force resistance device typically comprises a wheel having a drivably rotatable axle interconnected to one or more blades that forcibly engage against air on rotation of the axle, the wheel being interconnected to the downstream portion of the cable in an arrangement wherein the axle of the wheel is rotatably driven by the exercise speed, velocity, force, energy or power exerted by the user on the actuating device.

The axle of the wheel is preferably spring-load biased against rotation by the exercise speed, velocity, force, energy or power exerted by the user on the actuating device.

The degree of the second resistance typically varies non-linearly with the speed of rotation of the wheel.

The degree of the second resistance typically varies exponentially or geometrically with the speed of rotation of the wheel.

The manually movable actuating device can comprises a handle, a pivotable lever or a wheel interconnected to the proximal end of the cable.

The manifold is typically selectively interconnectable to a selectable number of the individual bodies of weight.

In another aspect of the invention there is provided a method of performing an exercise by a user comprising the user's selectively exerting a pulling or pushing force on the actuating device of the apparatus described above.

In another aspect of the invention there is provided a method of performing a weight lifting exercise on an exercise apparatus comprised of a weight stack comprised of one or more individual bodies of weight, a flexible elongated cable having a proximal end interconnected to a manually movable actuating device and a downstream portion extending downstream from the proximal end of the cable, the method comprising:

connecting the downstream portion of the cable mechanism directly to a user selectable number of one or more individual bodies of weight, arranging the cable such that the actuating device is interconnected to the proximal end of the cable and is manually engageable by a user to exert an exercise speed, velocity, force, energy or power on the proximal end of the cable via the actuating device that extends through the cable to the downstream portion of the cable, interconnecting the downstream portion of the cable in an arrangement such that the downstream portion of the cable pulls in one direction on the one or more individual bodies of weight via the exercise speed, velocity, force, energy or power exerted by the user, connecting the downstream portion of the cable directly to a second resistance mechanism in an arrangement that pulls on the second resistance mechanism such that the second resistance mechanism exerts a second resistance against the exercise speed, velocity, force, energy or power in a direction opposite the one direction, adapting the second resistance mechanism to exert the second resistance in a manner that varies non-linearly with one or more of the degree of exercise speed, velocity, force, energy or power exerted by the user on the second resistance mechanism or the actuating device.

The second resistance mechanism is preferably adapted to exert the second resistance in a manner that varies either exponentially or geometrically with the degree of exercise speed, velocity, force, energy or power exerted by the user.

The method typically further comprises adapting the force resistance mechanism to include a mechanical member that mechanically moves in response to the exercise speed, velocity, force, energy or power exerted by the user, the movement of the mechanical member mechanically generating the second resistance to vary non-linearly with the exercise speed, velocity, force, energy or power exerted by the user.

The method typically further comprises adapting the second resistance mechanism to exert the second resistance in a manner that varies exponentially or geometrically with the degree of exercise speed, velocity, force, energy or power exerted by the user on the second resistance mechanism or the actuating device.

In another aspect of the invention there is provided an exercise apparatus comprising:

a weight stack comprised of one or more individual bodies of discrete non-variable weight, a flexible elongated cable having a proximal end and a downstream portion extending downstream from the proximal end of the cable, the downstream portion of the cable mechanism being interconnected to a manifold that is directly connectable to a user selectable number of one or more individual bodies of weight that exert a first resistance and directly connected to a second resistance device that exerts a second resistance, a manually movable actuating device interconnected to the proximal end of the cable, the cable being arranged such that the actuating device is manually engageable and movable by a user to exert an exercise speed, velocity, force, energy or power on the proximal end of the cable that extends to the downstream portion of the cable and the manifold, the manifold being directly connected to the one or more individual bodies of weight in an arrangement that acts to pull in one direction on the one or more individual bodies of discrete, non-variable weight and to pull on the second resistance device, the manifold being directly connected to a movable component of the second resistance device such that an increase in the user's exertion of the exercise speed, velocity, force, energy or power on the actuating device results in movement of the movable component which exerts a degree of second resistance to movement of the actuating device that increases non-linearly with an increase in the degree of speed, velocity, force, energy or power exerted on the movable component or on the actuating device.

The degree of the second resistance preferably varies exponentially or geometrically with the degree of speed, velocity, force, energy or power exerted on the movable component or on the actuating device.

In another aspect of the invention there is provided an exercise apparatus comprising:

first and second manually movable actuating devices, each being interconnected to first and second cables respectively, the first and second cables being directly connected to first and second weight stacks respectively each comprised of first and second sets of one or more individual bodies of weight, the first and second cables each having first and second downstream portions respectively interconnected to the first and second user selectable sets of the one or more individual bodies of weight and to third and fourth resistance devices respectively, the first and second sets of one or more individual bodies of weight exerting first and second resistances respectively and the third and fourth resistance devices exerting third and fourth resistances, the first and second manually movable actuating devices being respectively interconnected to first and second proximal ends of the first and second cables, the first and second actuating devices being manually movable by the user to exert first and second exercise speeds, velocities, forces, energies or powers respectively through the first and second cables to the first and second downstream portions of first and second cables, the first and second downstream portions of the cables respectively pulling directly against the weight of the first and second sets of one or more individual bodies of weight and against the third and fourth resistance devices, the third and fourth resistances exerted by the third and fourth resistance devices each respectively increasing non-linearly with an increase in the degree of speed, velocity, force, energy or power exerted on the first and second manually movable actuating devices or on the third and fourth resistance devices by the user.

In such an apparatus movement of the first and second manually movable actuating devices by a user preferably effects mechanical movement respectively of third and fourth movable components of the third and fourth resistance devices that respectively increases the degree of the third and fourth resistances non-linearly with the degree of increase in speed or velocity of movement exerted on the movable component of the third and fourth resistance devices or the first and second actuating devices respectively.

In such an apparatus, the degree of the third and fourth resistances typically varies geometrically or exponentially with the degree of exercise speed, velocity, force, energy or power exerted on the first and second actuating device or the third and fourth resistance devices.

In such an apparatus the third and fourth resistance devices typically comprise third and fourth wheels respectively each having a drivably rotatable axle interconnected to one or more blades that forcibly engage against air on rotation of the axle, the third and fourth wheels being interconnected respectively to the first and second downstream portions of the first and second cables respectively in an arrangement wherein the axles of the third and fourth wheels are rotatably driven by the exercise speed, velocity, force, energy or power exerted by the user on the first and second actuating devices.

The axles of the wheels are preferably spring-load biased against rotation by the exercise speed, velocity, force, energy or power exerted by the user on the first and second actuating devices.

The degree of the third and fourth resistances typically varies non-linearly with the speed of rotation of the third and fourth wheels.

The degree of the third and fourth resistances typically varies exponentially or geometrically with the speed of rotation of the third and fourth wheels respectively.

The first and second manually movable actuating devices preferably each comprises a handle each being interconnected to a pivotable lever or a wheel that is interconnected to the first and second proximal ends of the first and second cables respectively.

The first and second downstream portions of the first and second cables are preferably directly connected to first and second manifolds respectively that are directly connectable to a selectable number of the individual bodies of weight of the first and second sets of individual bodies of weight respectively.

In another aspect of the invention there is provided a method of performing an exercise by a user comprising the user's selectively exerting a pulling or pushing force on one or the other or both of the manually movable actuating devices of the apparatus of the apparatuses described above.

In another aspect of the invention there is provided an exercise apparatus comprising:

a weight stack comprised of one or more individual bodies of weight, a flexible elongated cable having a downstream portion that is connected to a manifold that is connected to both a user selectable number of the one or more individual bodies of weight and to a second resistance device, the one or more individual bodies of weight exerting a first resistance and the second resistance device exerting a second resistance, a manually movable actuating device interconnected to a proximal end of the cable, the actuating device being manually movable by the user to exert an exercise speed, velocity, force, energy or power through the cable to the downstream portion of the cable and the manifold, the manifold pulling via the cable directly against the weight of the one or more individual bodies of weight and against the second resistance device, the second resistance exerted by the second resistance device increasing non-linearly with an increase in the degree of speed, velocity, force, energy or power exerted on the actuating device or on the second resistance device by the user.

In another aspect of the invention there is provided an exercise apparatus comprising:

a weight stack comprised of one or more individual bodies of weight, a flexible elongated cable having a downstream portion that is interconnected to a user selectable number of the one or more individual bodies of weight that exert a first resistance and to a second resistance device that exerts a second resistance, a manually movable actuating device interconnected to a proximal end of the cable, the actuating device being manually movable by the user to exert an exercise speed, velocity, force, energy or power through the cable on the selectable number of one or more individual bodies of weight and on the second resistance device, the second resistance device exerting a second resistance that increases non-linearly with an increase in the degree of speed, velocity, force, energy or power exerted on the actuating device or on the second resistance device by the user.

In another aspect of the invention there is provided an exercise apparatus comprising:

a weight stack comprised of one or more individual bodies of discrete non-variable weight, a flexible elongated cable having a proximal end and a downstream portion extending downstream from the proximal end of the cable, the downstream portion of the cable mechanism being interconnected to a user selectable number of one or more individual bodies of weight that exert a first resistance and to a second resistance device that exerts a second resistance, a manually movable actuating device interconnected to the proximal end of the cable, the cable being arranged such that the actuating device is manually engageable and movable by a user to exert an exercise speed, velocity, force, energy or power on the proximal end of the cable extending to the downstream portion of the cable to act in one direction on the one or more individual bodies of discrete, non-variable weight and on the second resistance device, the second resistance device exerting a degree of second resistance to movement of the actuating device by the user that varies non-linearly with the degree of exercise speed, velocity, force, energy or power exerted on the actuating device or on the second resistance device, the second resistance being exerted in a direction opposite the one direction.

In such an apparatus movement of the actuating device by the user preferably effects mechanical movement of a movable component of the second resistance device that increases the degree of the second resistance non-linearly with the degree of increase in speed or velocity of movement exerted on the movable component of the second resistance device or the actuating device.

The degree of the second resistance preferably varies geometrically or exponentially with the degree of exercise speed, velocity, force, energy or power exerted on the actuating device or the second resistance device.

The second force resistance device typically comprises a wheel having a drivably rotatable axle interconnected to one or more blades that forcibly engage against air on rotation of the axle, the wheel being interconnected to the downstream portion of the cable in an arrangement wherein the axle of the wheel is rotatably driven by the exercise speed, velocity, force, energy or power exerted by the user on the actuating device.

The axle of the wheel is preferably spring-load biased against rotation by the exercise speed, velocity, force, energy or power exerted by the user on the actuating device.

The degree of the second resistance typically varies non-linearly with the speed of rotation of the wheel.

The degree of the second resistance typically varies exponentially or geometrically with the speed of rotation of the wheel.

The manually movable actuating device preferably comprises a handle, a pivotable lever or a wheel interconnected to the proximal end of the cable.

The downstream portion of the cable is preferably interconnected to a manifold that is interconnected to the second resistance mechanism, the manifold being selectively interconnectable to a selectable number of the individual bodies of weight.

In another aspect of the invention there is provided a method of performing a weight lifting exercise on an exercise apparatus comprised of a weight stack comprised of one or more individual bodies of weight, a flexible elongated cable having a proximal end interconnected to a manually movable actuating device and a downstream portion extending downstream from the proximal end of the cable, the method comprising:

interconnecting the downstream portion of the cable mechanism to a user selectable number of one or more individual bodies of weight, arranging the cable such that the actuating device is manually engageable by a user to exert an exercise speed, velocity, force, energy or power on the proximal end of the cable extending to the downstream portion of the cable to act in one direction to move the selected number of the one or more individual bodies of weight, interconnecting the downstream portion of the cable to a second resistance mechanism in an arrangement such that the second resistance mechanism exerts a second resistance against the exercise speed, velocity, force, energy or power in a direction opposite the one direction, adapting the second resistance mechanism to exert the second resistance in a manner that varies non-linearly with one or more of the degree of exercise speed, velocity, force, energy or power exerted by the user on the second resistance mechanism or the actuating device.

In such a method, the second resistance mechanism can be adapted to exert the second resistance in a manner that varies either exponentially or geometrically with the degree of exercise speed, velocity, force, energy or power exerted by the user.

Such a method can further comprise adapting the force resistance mechanism to include a mechanical member that mechanically moves in response to the exercise speed, velocity, force, energy or power exerted by the user, the movement of the mechanical member mechanically generating the second resistance to vary non-linearly with the exercise speed, velocity, force, energy or power exerted by the user.

In such a method, the second resistance mechanism can comprise a wheel having a drivably rotatable axle interconnected to one or more blades that forcibly engage against air on rotation of the axle, the wheel being interconnected to the downstream portion of the cable in an arrangement wherein the axle of the wheel is rotatably driven by the exercise speed, velocity, force, energy or power exerted by the user.

In such a method the wheel is typically biased by a spring against rotation by the exercise speed, velocity, force, energy or power exerted by the user.

Such a method can further comprise adapting the wheel such that the speed of rotation of the wheel varies non-linearly with one or more of the degree of exercise speed, velocity, force, energy or power exerted by the user on the wheel or the actuating device.

Such a method can further comprise adapting the wheel such that the speed of rotation of the wheel varies exponentially or geometrically with the degree of exercise speed, velocity, force, energy or power exerted by the user on the wheel or the actuating device.

Such a method can further comprise adapting the wheel to vary the second resistance either exponentially or geometrically with the degree of exercise speed, velocity, force, energy or power exerted by the user on the wheel or the actuating device.

Such a method can further comprise adapting the wheel to vary the second resistance non-linearly with the speed of rotation of the wheel.

In another aspect of the invention there is provided an exercise apparatus comprising:

a weight stack comprised of one or more individual bodies of discrete non-variable weight, a flexible elongated cable having a proximal end and a downstream portion extending downstream from the proximal end of the cable, the downstream portion of the cable mechanism being interconnected to a user selectable number of one or more individual bodies of weight that exert a first resistance and to a second resistance device that exerts a second resistance, a manually movable actuating device interconnected to the proximal end of the cable, the cable being arranged such that the actuating device is manually engageable and movable by a user to exert an exercise speed, velocity, force, energy or power on the proximal end of the cable extending to the downstream portion of the cable to act in one direction on the one or more individual bodies of discrete, non-variable weight and on the second resistance mechanism, the downstream portion of the cable being interconnected to a movable component of a second resistance device such that an increase in the user's exertion of the exercise speed, velocity, force, energy or power on the actuating device results in movement of the movable component which exerts a degree of second resistance to movement of the actuating device that increases non-linearly with an increase in the degree of speed, velocity, force, energy or power exerted on the movable component or on the actuating device.

In such an apparatus, the movable component can comprise a fan that rotates at a selected speed or velocity in response to the user's exertion of a selected degree of the speed, velocity, force, energy or power exerted on the actuating device, the second degree of resistance exerted by the fan increasing non-linearly with an increase in the selected speed or velocity of rotation of the fan.

In such an apparatus, the second degree of resistance exerted by the fan can increases by a cube factor of increase in the selected speed or velocity of rotation of the fan.

In all such an apparatuses and methods according to the invention the second resistance mechanism can mechanically vary resistance to a degree that varies either exponentially or geometrically with the degree of speed, velocity, force, work or power exerted by the user on a mechanically movable component of the apparatus such as a handle, a cable or another movable device or assembly. The term "non-linear" or "non-linearly" is meant to encompass and include an exponential or geometric relationship such as a cubed or cube factor relationship between an increase in degree of resistance and an increase in degree of speed, velocity, force, work or power exerted by the user. Also, as discussed below, the term "force" is intended to encompass and include user exerted power, energy or work which are all directly proportional to force.

BRIEF DESCRIPTION OF THE DRAWINGS

The above and further advantages of the invention may be better understood by referring to the following description in conjunction with the accompanying drawings in which.

DETAILED DESCRIPTION

Figure 1:
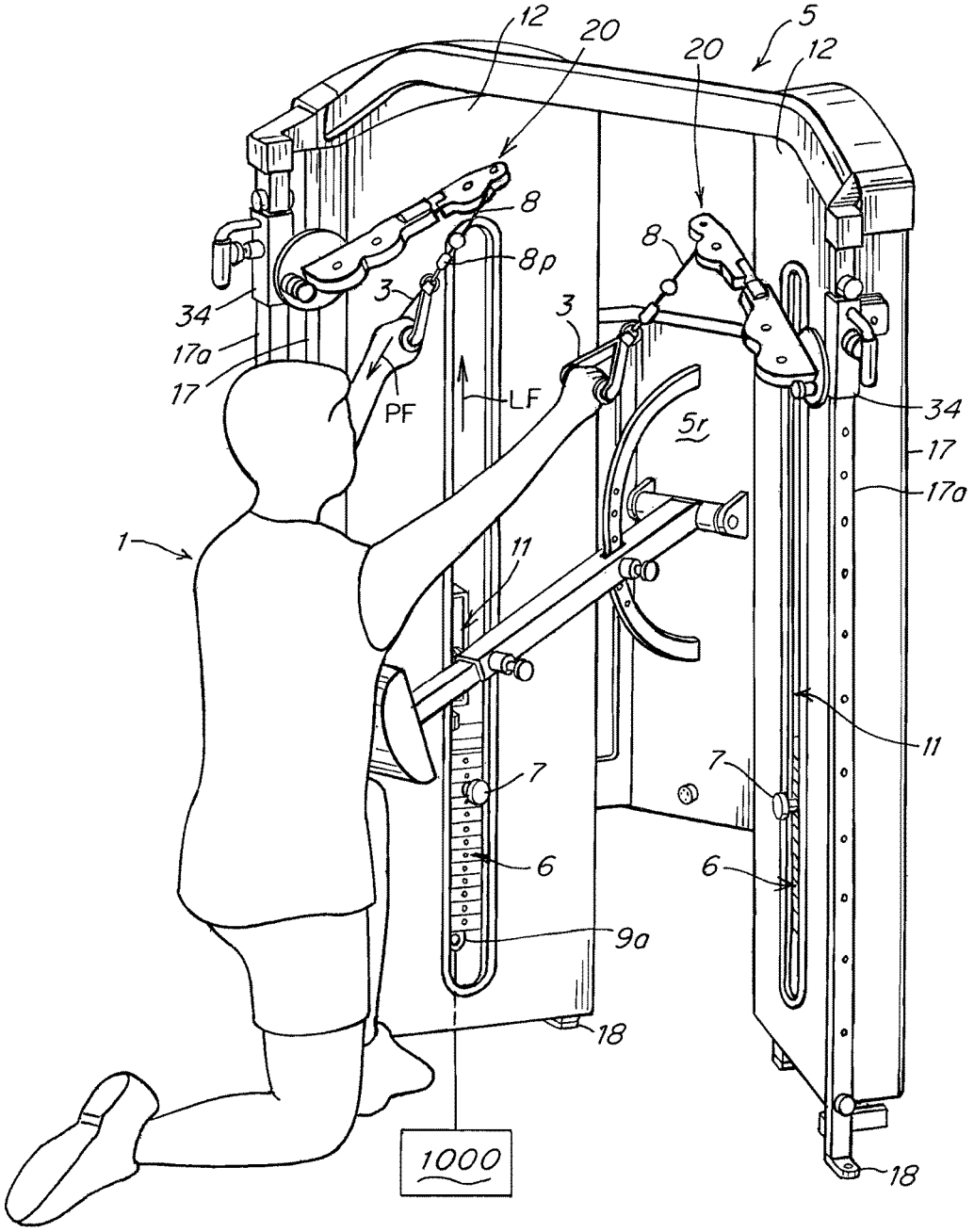
FIG. 1 is a front perspective view of an exercise apparatus having an incremental weight and associated lifting mechanism without a means for preventing the user from exerting an excess of force on the incremental weights.
Figure 2:
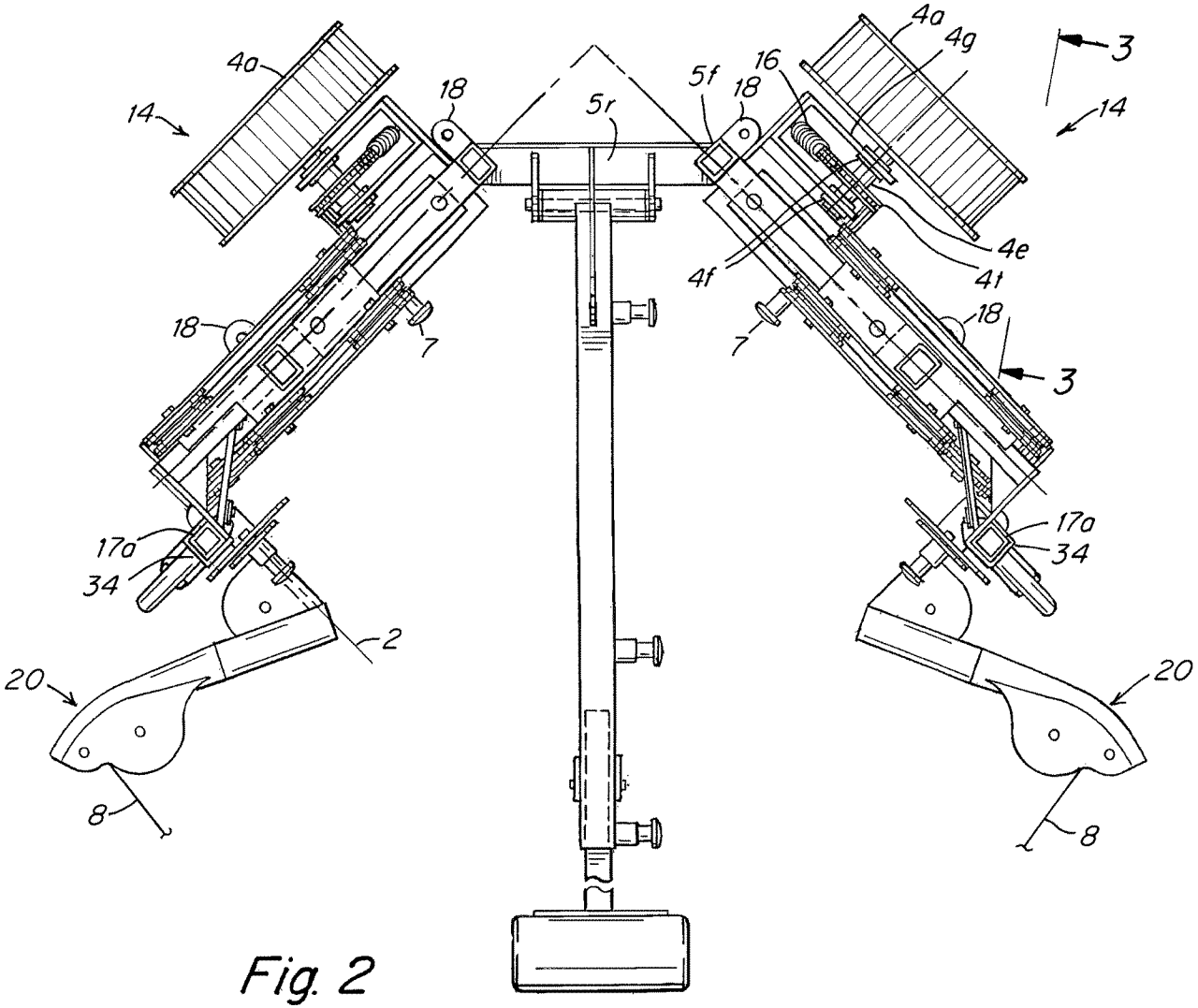
FIG. 2 is a top view of the apparatus of FIG. 1 showing a non-linearly force varying resistance mechanism interconnected to the incremental weight lifting mechanism.

FIGS. 1-6 show one example of an exercise apparatus comprised of a weight stack 6 that is comprised of one or more individual bodies of discrete weight, a flexible elongated cable 8 having a downstream portion 11 that is interconnected to a user selectable number of the one or more individual bodies of weight that exert a first resistance and to a second resistance device 14 that exerts a second resistance, a manually movable actuating device 3 interconnected to a proximal end 8*p* of the cable, the actuating device 3 being manually movable by the user to exert an exercise speed, velocity, force, energy or power PF through the cable 8 on the selectable number of one or more individual bodies of weight 6 and on the second resistance device 14, the second resistance device exerting a second resistance OF that increases non-linearly with an increase in the degree of speed, velocity, force, energy or power exerted PF on the actuating device 3 or on the second resistance device 14 by the user.

FIG. 1 shows one example of an exercise apparatus 5 having a stack of incremental weights 6 interconnected to a handle 3 that is interconnected to a proximal end of a weight lifting cable 8. The handle 3 is manually engageable by a user 4 to exert a pulling or pushing exercise force PF. The incremental weights 6 provide a resistance that is constant and does not vary non-linearly with the degree of force PF, LF exerted by the user but rather varies directly with the amount of the weights 6. The weights are mounted and arranged to enable the user 4 to selectively interconnect via a pin 7 any desired number 6*s* of the weights 6 to a manifold 9, which is in turn interconnected to a downstream portion 11 of the cable 8. The stack of incremental weights 6 are slidably mounted on rails 13 within a housing 12 that mechanically mount the weights 6 for movement along a predefined direction of travel 140, FIG. 3, when the downstream portion 11 of the cable exerts a lifting force LF on the manifold 9 that originates with the exercise force PF which is exerted downstream through the cable 8 to the downstream portion 11 to exert the lifting force in one direction LF. The stack 6 shown in the embodiments of the figures comprises a stack of separate individual bodies of weight, any selective number 6*s* of which can be interconnected to the main cable/pulley assembly before beginning an exercise, e.g. by inserting a pin 7 through a lateral aperture provided in each of the incremental weights in the stack 6 and continuing through a complementary aligned aperture provided in the weight-bearing rod or manifold 9 which is interconnected to pulley 56. Other varying weight resistance mechanisms can be provided in alternative embodiments such as free weights, containers fillable with a selective amount of fluid or the like.

Figure 3:
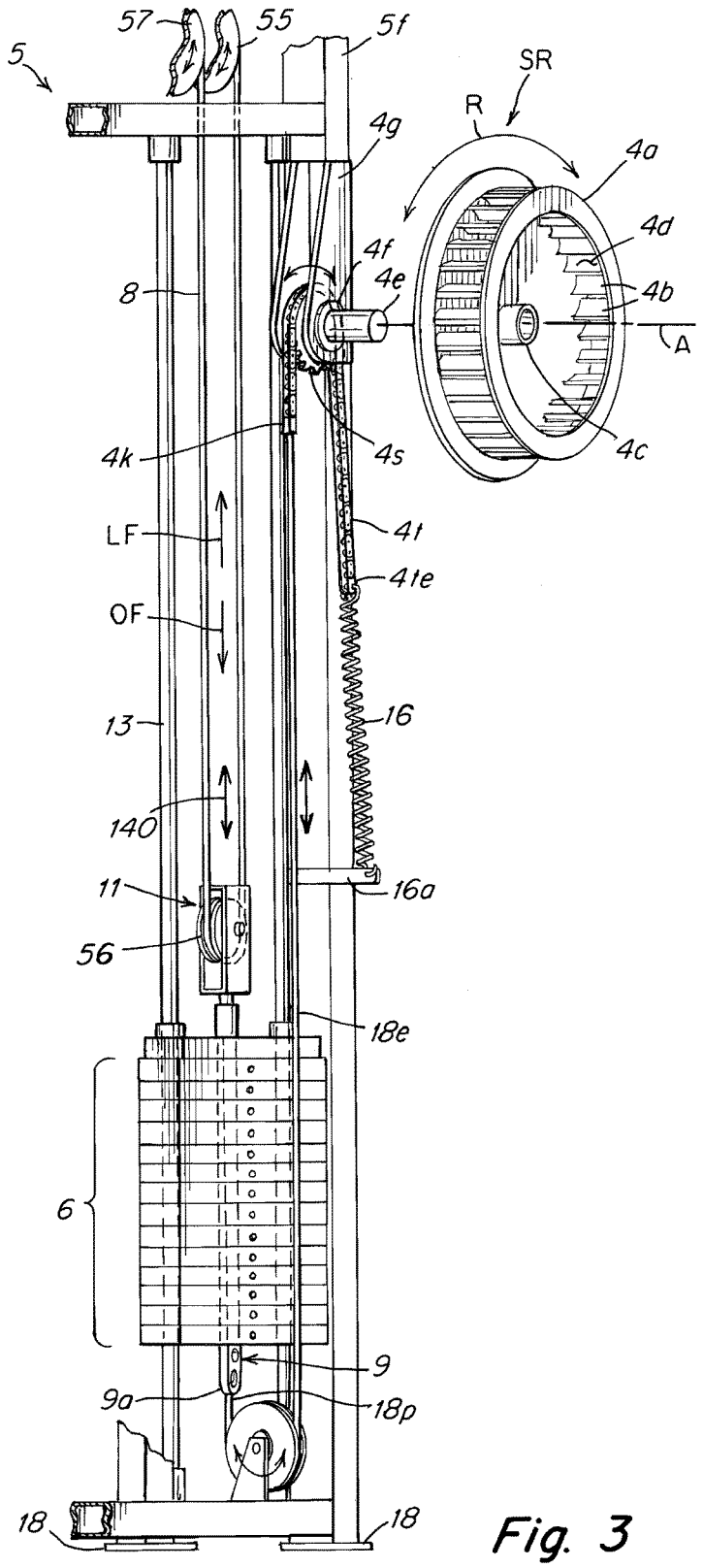
FIG. 3 is a front right perspective view taken along lines 3-3 of FIG. 2 showing the detail of the interconnection of the non-linearly force varying resistance mechanism to the weight lifting mechanism.
Figure 3A:
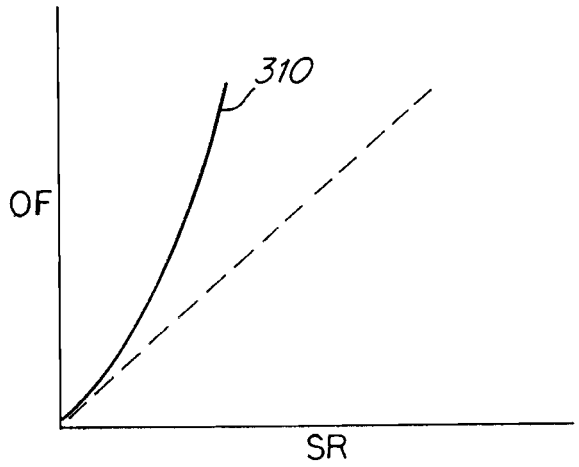
FIG. 3A is a plot of opposing force OF versus speed of rotation SR.
Figure 5:
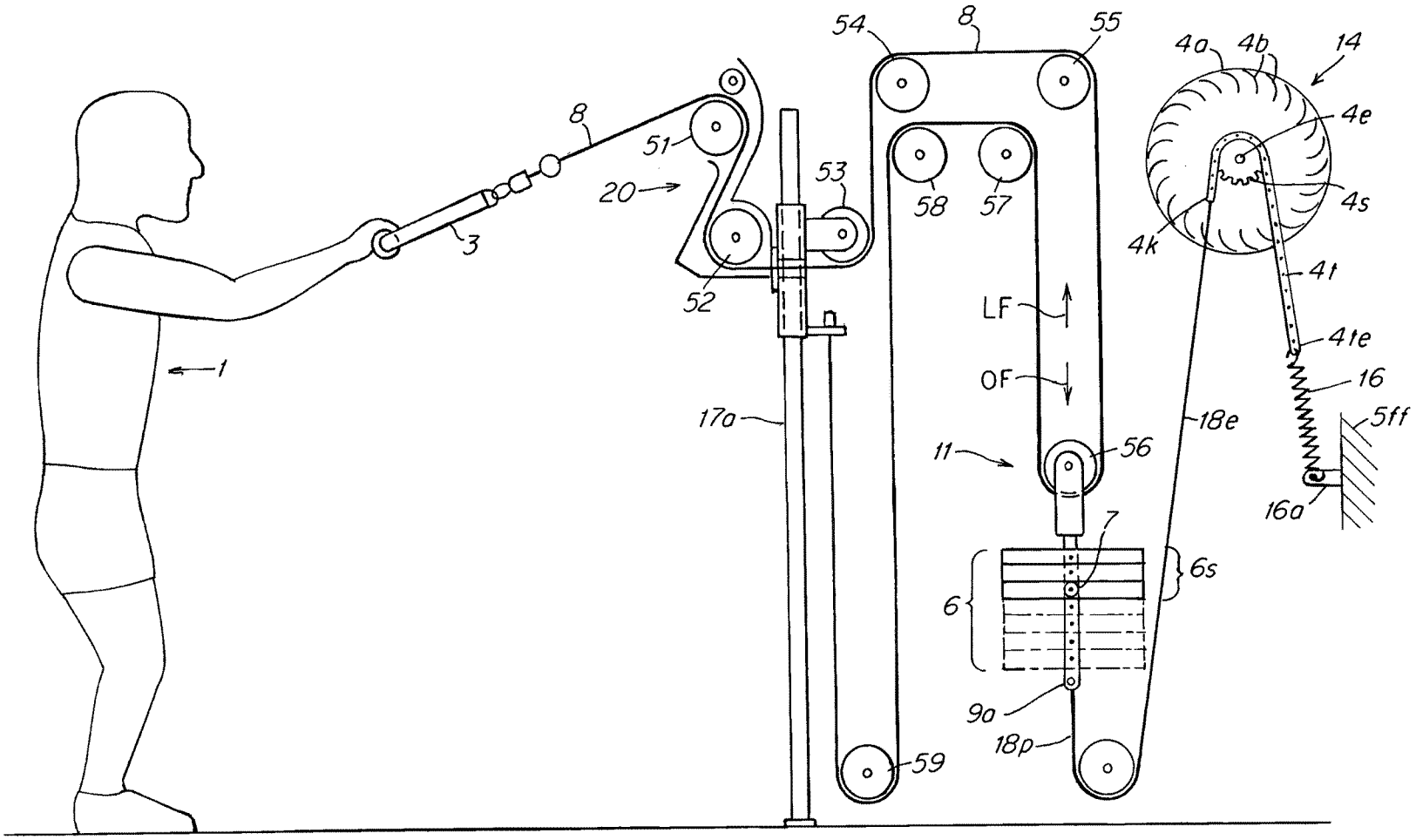
FIG. 5 is a schematic side view of the apparatus of FIGS. 2-4 showing the user in a weight lift exercise start position.
Figure 6:
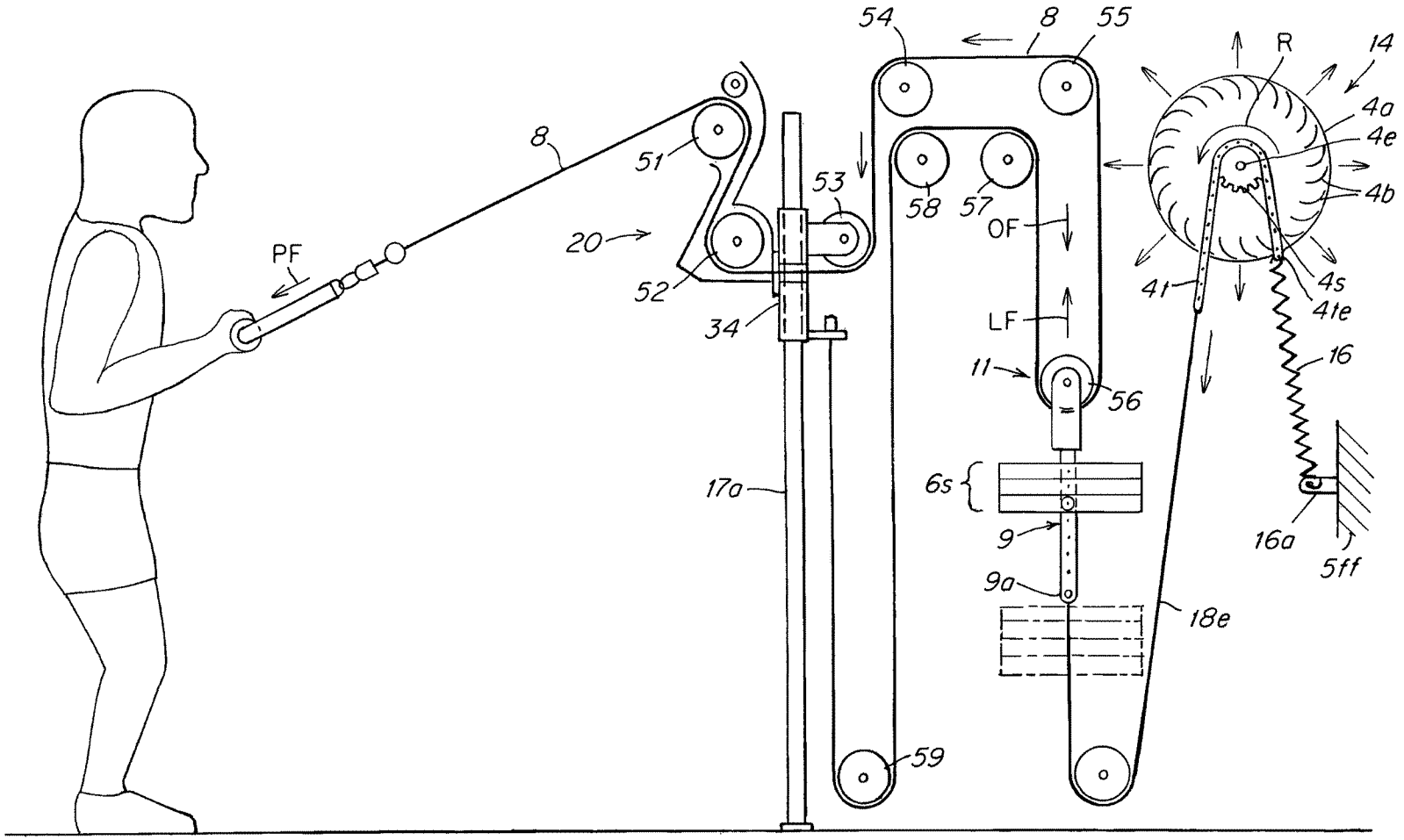
FIG. 6 is a schematic side view of the apparatus of FIGS. 2-4 showing the user in a weight lift exercise position subsequent to the start position where the user is exerting force to lift one or more of the incremental weights and the non-linearly varying force resistance mechanism is opposing the exercise force.

As shown in FIG. 1 when the user exerts the exercise force PF which results in force LF being exerted on the manifold 9 and its interconnected incremental weights, the resistance mechanism 1000 exerts a force OF in addition to the weight force of the selected number 6*s*, FIGS. 5, 6, of a set of incremental weights 6 in opposition to the force LF along the direction OF. The resistance mechanism 1000 is adapted to vary the degree of opposing force OF in a non-linear relationship 300, FIG. 3A, relative to the degree of user exercise force LF, typically to increase the amount of opposing force OF exponentially or geometrically relative to an increase in exercise force PF. The non-linearly increasing resistance mechanism 1000 can comprise a mechanical, electromechanical (such as an eddy current brake), electrical or computer or software controlled mechanism that is interconnected in some fashion to the downstream portion 11 of the cable 8 such as via attachment to the downstream end 9*a* of the manifold 9 that is interconnected to the cable portion 11.

As can be readily imagined, the non-linear, geometric, exponential or the like increase "resistance" that results from the use of a mechanism 1000 such as a fan 4*a*, pertains equally to resistance as measured in units of force, work, energy and power which are all directly proportional to each other and which would all thus increase non-linearly or geometrically or exponentially with an increase of user exerted force PF, LF or the like. The term "non-linear" or "non-linearly" is meant to encompass and include an exponential or geometric relationship between the resistance and force exerted. Also, as discussed below, the term "force" is intended to encompass and include user exerted power, energy or work which are all directly proportional to force.

In the more specific embodiments shown in FIGS. 2-3, 4-8, the resistance mechanism 4 comprises a fan wheel 4*a* having an axle 4*c* mounted on a drive shaft 4*e* driven by a chain 4*t* that is meshed with a sprocket 4*s* mounted to the shaft 4*e*. The shaft is rotatably R mounted on the brackets 4*g* via bearings 4*f* that are mounted on brackets 4*g* that are in turn mounted to the frame portion 5*f* of the frame or apparatus 5. Air resistance or fan blades 4*b* having air impingement surfaces 4*d* are mounted to the wheel 4*a* and interconnected to the driven axle 4*c* such that the blades 4*b* rotate R in unison with the wheel 4*a* causing the surfaces 4*d* to impinge on ambient air and resist rotation R of the wheel 4*a* and axle 4*c*. The rate or speed of rotation SR, FIG. 3A of the axle 4*c* and wheel 4*a* varies in a non-linear, exponential or geometric fashion 310 with the degree of force that opposes the user OF, such force being generated by the impingement and flux of air resulting from rotation R of the wheel 4*a* with the blades 4*b* of the wheel 4*a*. Typically the degree of resistance OF to rotation R of a fan or finned wheel 4*a* increases or varies by a cube or cubed factor of or with the degree of speed of rotation R. Other resistance mechanisms other than a finned or fan wheel assembly 14 such as an Eddy current controlled brake mechanism can be employed that controllably increase, decrease or vary the degree of resistance generated by the resistance mechanism relative to the force F (or speed, velocity, power or energy) exerted by the user in a non-linear, geometric or exponential manner or relationship.

The axle 4*c* is rotatably driven by the force PF, LF exerted by the user 1, the force LF being transmitted to the chain 4*t* via interconnection of a proximal end 18*p* of the intermediate cable 18*e* to the distal end 9*a* of rod 9 such that the pull cable 18*e* extends between the proximal end 4*k* of the chain 4*t* and the distal end 9*a* of the manifold 9. Exertion of the force LF causes the distal end of the intermediate pull cable 18*e* to pull on the proximal end 4*k* of the chain 4*t* thus causing the chain 4*t* to rotate R together with the drive shaft and further causing the distal end 4*te* of the chain 4*te* to pull on and stretch or extend the spring 16 creating a pull tension within the chain that acts to pull on the chain 4*t* in the direction of the opposite force OF.

Figure 4:
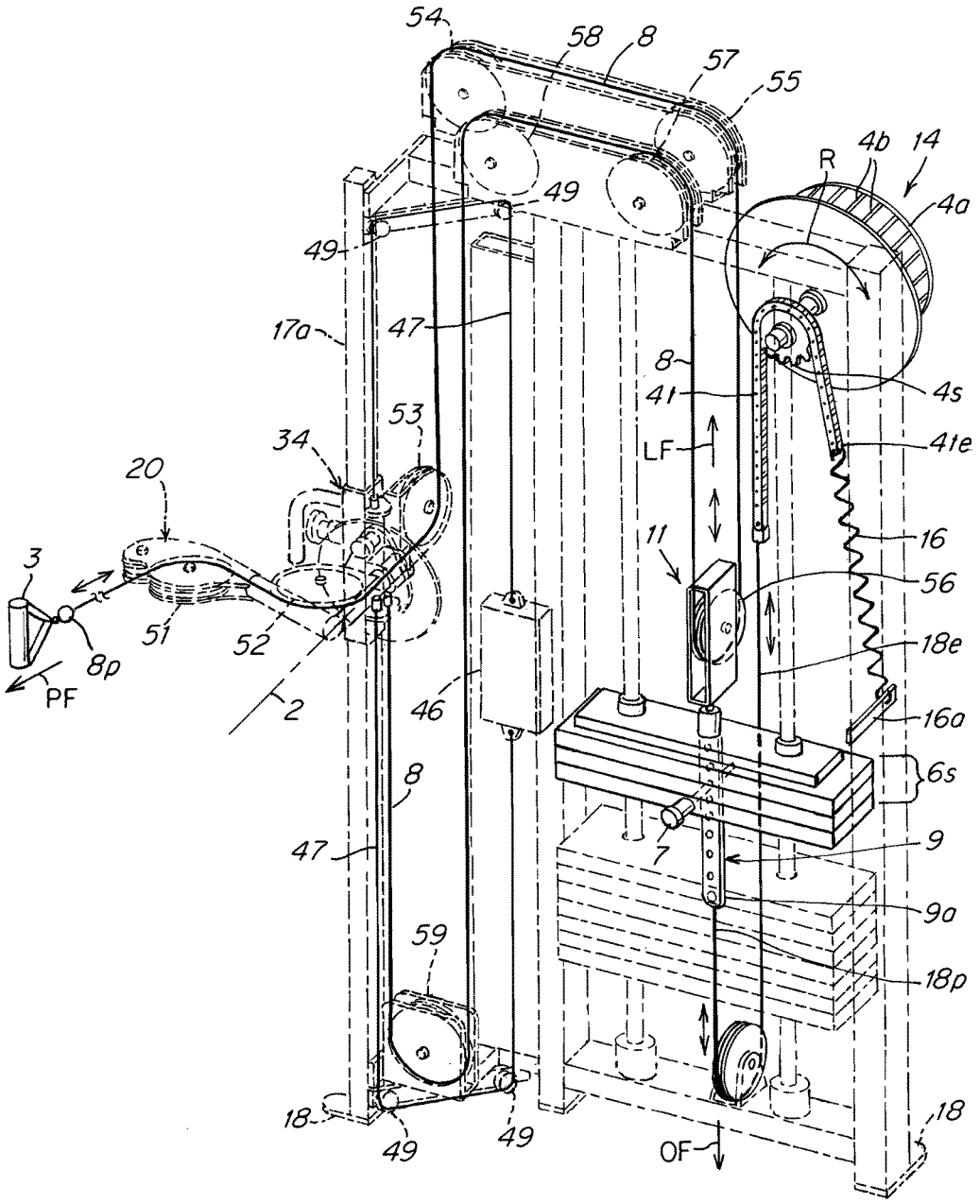
FIG. 4 is a more inclusive front right perspective view of the apparatus of FIG. 2.

The distal end 4*te* of the chain 4*t*, FIG. 4, is interconnected to a spring 16 that is connected to an arm 16*a* or other component that is fixedly interconnected to a frame portion 5*ff* of the apparatus 5. The spring 16 exerts a relatively small additional opposing force against the user exerted force LF when the cable portion 11 acts to exert LF on the selected number 6*s* of incremental weights 6 thus causing the spring 16 to be stretched or extended thus increasing the tension force in the spring and concomitantly increasing the opposing force OF. When the user 1 stops exerting the force LF, the distal end 9*a* of the manifold 9 travels downstream toward the spring 16 thus allowing the chain 4*t* to rotatably travel in the opposite direction OF around the sprocket 4*s* downstream toward the spring 16 with the spring 16 being under tension and pulling on the distal end 4*te* of the chain 4*t* to cause the end 4*te* to travel downstream and simultaneously keeping the chain 4*t* under tension.

In the machine shown in FIGS. 1-3, 4-6, a main cable/pulley assembly 54, 55, 57, 59 in which a single flexible cable 24 extends from the handle 3 through a rotating arm 20 which is attached via pulleys to the weight stack 6 and ultimately to the frame 5 seated on the floor via feet 18. A second cable/pulley assembly 46, 47, 49 which functions as a counterbalance to the weight of the arm 20 is also shown. As shown the handle/arm 20 is disposed centrally along the height of the rail 17*a*, which can be adjusted to alternative positions at lowermost and uppermost positions on the rail 17*a*. The distal end of main cable 24 is shown extending from rotating arm 20. The rotating arm 20 is disposed at a central vertical position, as determined by the position of slider 34 on the front upright frame member 17. The arm is shown in a forwardly rotated position (with respect to the rear mounting frame element 5*r* of the frame 5). The cable 24 is routed through two pulleys 51-52 in the arm 20 and passes through the selected rotation position defined by rotation axis 2. The cable 24 is further routed around a series of pulleys 53-59 which are all mounted such that when the handle 3 is pulled (or pushed) outwardly from the distal end of arm 20, the downstream portion 11 of cable 24 that is routed around pulley 56 pulls upwardly on interconnected manifold 9 that is in turn interconnected to selected ones 6*s* of the weight stack 6.

Figure 7:
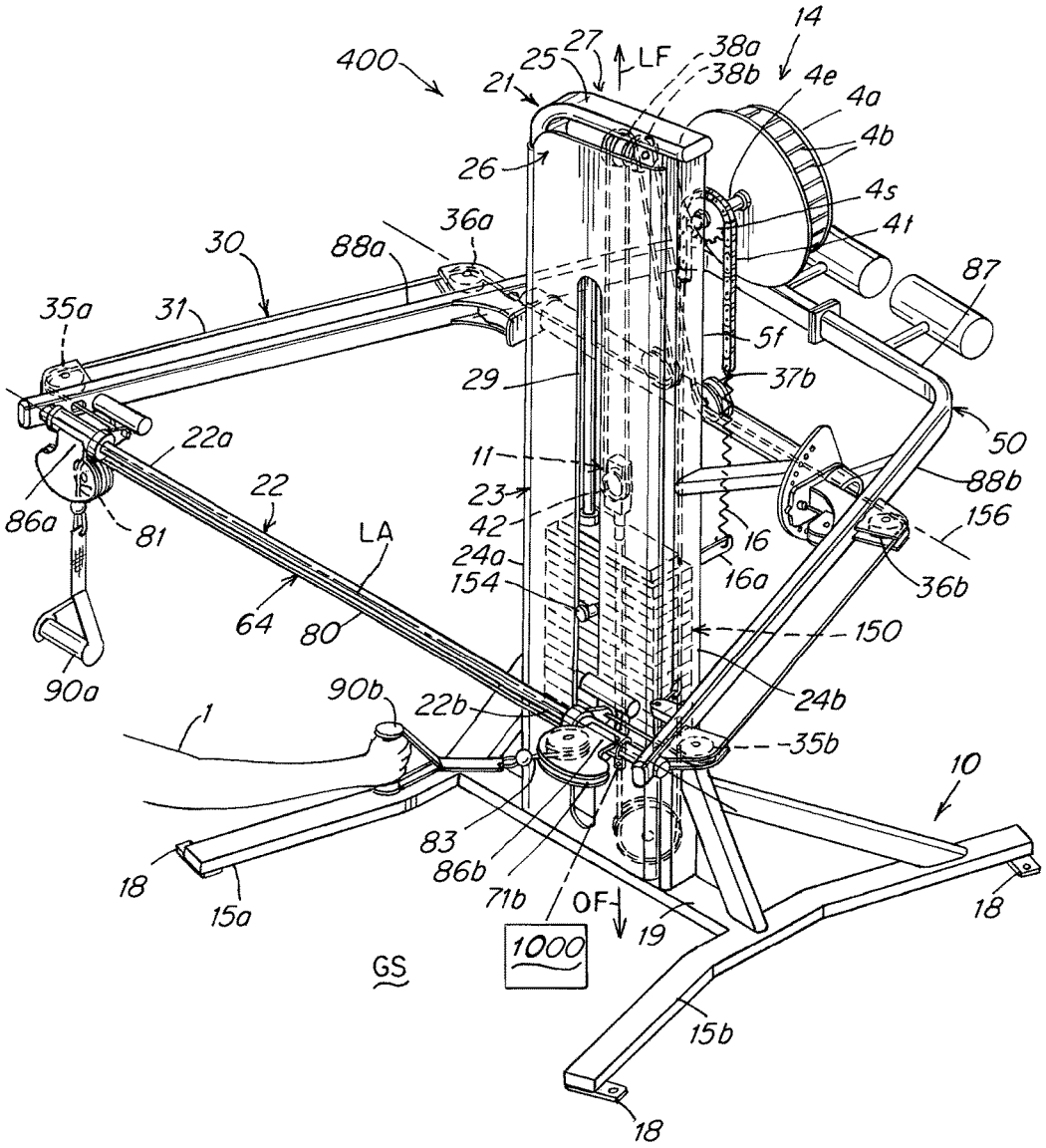
FIG. 7 is a top perspective schematic view of another example of an exercise apparatus having a user engageable weight lifting subassembly interconnected to a non-linearly varying resistance mechanism showing the user in an exercise start position.
Figure 8:
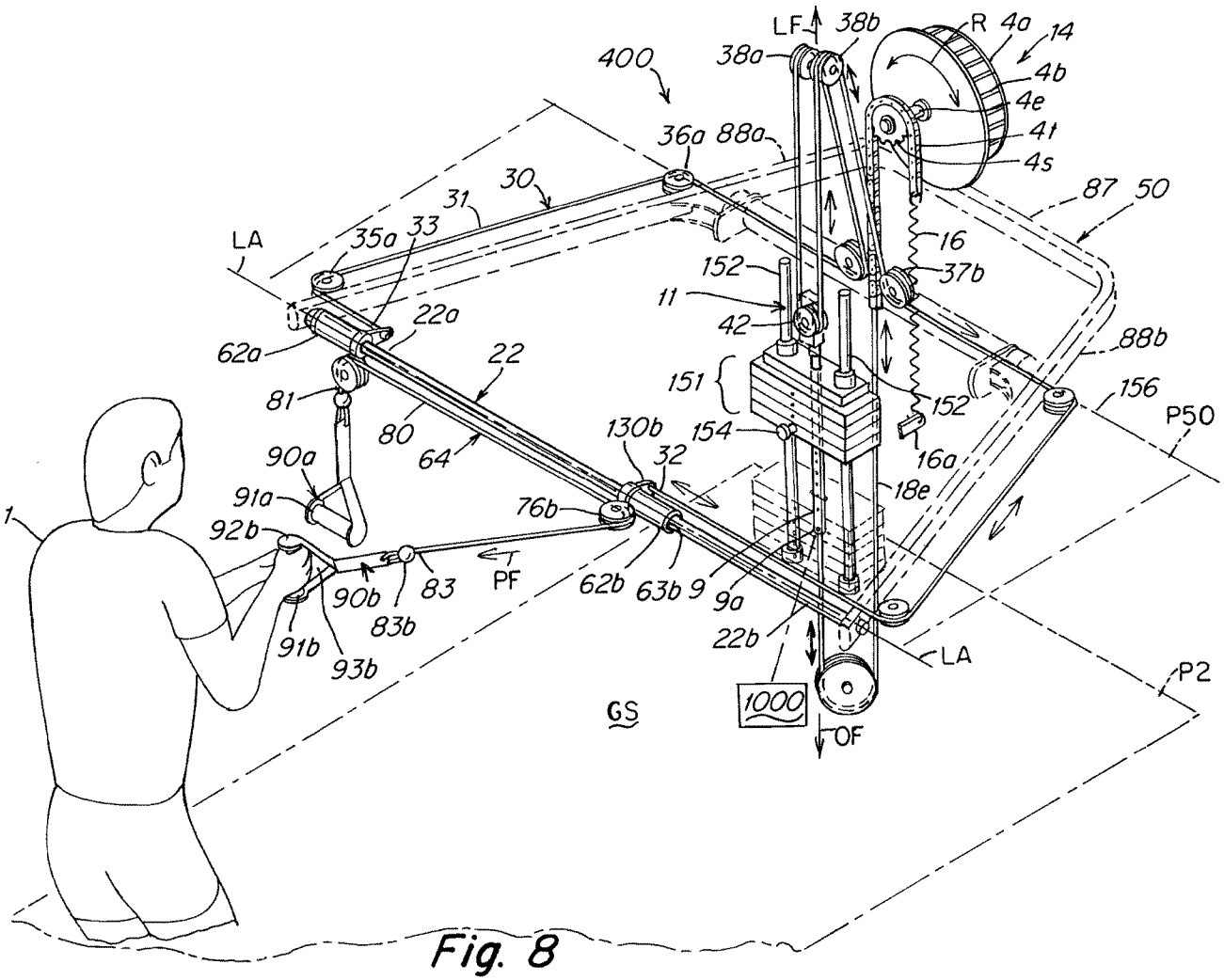
FIG. 8 is a view of the FIG. 7 apparatus showing the user in a subsequent exercise position exerting an exercise force on the weight stack and non-linearly varying force resistance mechanism.

In the machine shown in FIGS. 7, 8 a non-linear varying resistance mechanism 1000 that generates an opposing force OF to the user exercise force LF is generically shown as being interconnected to the distal end 9*a* of a manifold 9 that enables a user 4*u* to select a selected number 151 of a stack of incremental weights 150. The mechanism typically increase the amount of force OF exponentially or geometrically with increase of lifting force LF. A specific embodiment of a resistance mechanism 14 having air resistance blades 4*b* operates in the same fashion as described above regarding the wheel 14 and its associated components such that rotation R, SR of the wheel 14 creates an opposing force OF that varies non-linearly 310, FIG. 3A with the degree of degree of speed, velocity, force PF, work or power exerted by the user on a mechanically movable component of the apparatus such as a handle 3, a cable 8 or resistance mechanism wheel 4*a*.

As shown in FIGS. 7, 8 the machine comprises a rod 12 having a longitudinal axis LA, the rod is mounted on the frame such that the longitudinal axis is disposed generally horizontally relative to the ground surface plane P2 which supports the frame and a user. The apparatus 10 includes a base member 14 disposed generally parallel and adjacent to a horizontal plane P2 of the ground surface 2. The base 14 includes left and right elongated feet members 15*a*, 15*b*, joined by a cross bar 19. At the ends of each foot are mounting pads 16 with holes for bolting the front and rear ends of the feet to the ground surface 2 to maintain the machine in a stationary position. On top of the central cross bar 19 there is mounted a central vertical column or support 22 including a vertically-disposed housing 23 that encloses a weight stack 150. The housing includes left and right end supports (e.g., hollow tubes) 24*a*, 24*b* that are joined by a top support (e.g. hollow tube) 25, along with a front cover 26 and a rear cover 27 that define a central cavity 28 in which the weight stack resides. An elongated vertical opening 29 in the front cover 26 provides access to an adjustable pin 154 for selecting a number of weights in the stack to be attached to a connector (resistance) cable, thereby adjusting the amount of force required by the user to extend the pull handle assemblies 60*a*, 60*b*. The rod 12 on which the slidable handle bracket assemblies 60*a* and 60*b* are mounted, forms one side of a rectilinear pivot arm structure 50. The arm structure 50 includes left and right side arms 52*a*, 52*b* each joined at their rear ends to opposite ends of a transverse rear arm 51, wherein all three arms and the front rod 12 lie in a single horizontal plane P50 that in FIG. 1 is substantially parallel to the ground surface plane P2. With the pivot arm 50 in the middle position, the front rod 12 is in the same horizontal plane P50 as the arm structure 50, parallel to the ground surface plane, and the rod 12 is disposed roughly three feet above the ground surface plane P2. This central position provides easy access by a user standing in front of the machine 10 and rod 12 for engaging and grasping the handles 90*a*, 90*b* in order to pull on the handle(s) and as a result slide the handle bracket(s) across the rod 12.

The arm structure 50, FIGS. 7, 8 including left and right side arms 52*a*, 52*b* and supporting rod 12, can be pivoted about a generally horizontal axis which is disposed parallel to a ground surface plane. Pivoting the arm structure 50 clockwise about the axis enables the user to raise the front rod upwardly, so that the handle assemblies are now further away from the ground surface (e.g., about five feet above the ground 2) than in the middle position, while still maintaining the rod 12 in a plane substantially parallel to the ground surface plane. Alternatively, pivot arm 50 can be pivoted in the opposite direction (counterclockwise), lowering the rod so that the handles are now closer to the ground, FIGS. 7, 8 and a user 4*u* disposed in front of the machine now will pull upwardly on the handles. Again, the rod is always maintained in a substantially horizontal plane parallel to the ground surface plane, but the distance from the ground surface plane varies depending on the pivoted position of arm structure 50 on the frame.

The pull cable assembly 68 is directly engaged by the user; it includes a pull cable 80 having a left end 81 engagable with the left slidable handle bracket 60*a*, and a right cable end 82 engagable with the right slidable handle bracket 60*b*. The left and right handle brackets 60*a*, 60*b* are initially disposed at opposing left and right ends 13*a*, 13*b* of the rod 12. When a user grasps the grip 91*b* of right handle 90*b* and pulls it toward himself, the right handle bracket 60*b* is caused to slide across the rod 12 toward the left handle bracket 60*a*, the latter being fixed in position on the left hand end 13*a* of rod 12 by its engagement with the resistance cable assembly 30 attached to the weight stack 150.

More specifically, the right handle bracket 60*b* includes a slidable sleeve (e.g., tube) 62*b* having a central bore 63*b* which slidably engages the outer cylindrical surface of rod 12. A pulley housing 71*b* attached to slidable tube 62*b* mounts a pulley wheel 76*b*, over which a pull cable 80 can be pulled (by a user) while the wheel rotates. At the right end 82 of pull cable 80, a stop ball 83*b* is provided that prevents the pull cable from being pulled out of the handle bracket 60*b* when the user pulls on the opposing handle 90*a*. The right end 82 of cable 80 is attached by a metal ring 84*b* to a Y-shaped handle frame 92*b*. A grip 91*b* is supported across the open ends 94*b* of the Y-shaped frame 92*b*, wherein an opening 93*b* between the grip and Y-shaped frame allows the user's fingers to be inserted for grasping the grip 91*b*. The opposing end 95*b* of the Y-frame 92*b* has an aperture which receives the ring 84*b* for connecting the stop ball 83*b* between the handle 90*b* and pull cable 80.

The right handle bracket assembly 60*b* further includes a tabbed collar 130*b* attached to the slidable tube 62*b* for connecting the handle bracket 60*b* to the resistance cable assembly 30. More specifically, a first end 32 of resistance cable 31 is attached to the tab portion of the collar 130*b*. The resistance cable 31 extends from collar 130*b* around four right side pulley wheels 35*b*-38*b*, and then around a central pulley 42 which is attached to the weight stack 150. The opposing left end 33 of resistance cable 32 is similarly engaged with the left handle bracket 60*a* and a mirror image pulley assembly with four pulley wheels, and ultimately engages the same central pulley wheel 42 engaged with the same common weight stack 150. Thus, in the present embodiment, a single resistance cable assembly 30 connects the left and right slidable handle brackets 60*a*, 60*b*, while a separate pull cable assembly 68 similarly connects the left and right handle brackets 60*a*, 60*b*, and together the two separate cable assemblies 30 and 68, which each engage the left and right slidable handle brackets 60*a*, 60*b*, enable the resistance training motion and exercises illustrated in the figures.

When a user 4 grasps the right handle 90*b* and pulls the handle 90*b* toward himself while moving away from the machine 10, thereby extending the right handle away from the rod, he pulls against the resistance set by the resistance cable assembly 30 which is attached to a select number of weights in the weight stack 150. Here, an adjustable pin selects the upper 151 weights in the stack as a desired fixed weight resistance level, while the user pulls on the right handle these upper 151 weights rise upwardly along the parallel guide rods 152 of the weight stack. As a result the right handle bracket 62*b* slides to the left on the rod, allowing the pull cable 80 to extend further toward the user while the user continues to exert sufficient force to overcome the selected weight resistance 151 (upper weights of the stack). The left handle bracket 60*a* remains stationary with respect to the frame 5, the stop ball 83*a* preventing the pull cable 80 from disengaging with the left handle bracket, and the resistance cable 31 attached to the left handle bracket resisting the force on the pull cable 80 exerted by the user pulling on the right handle.

As shown in FIGS. 7, 8 the pivot arm structure 50 is rotated counterclockwise about its axis to a lowermost position, wherein the rod is now horizontally aligned in a plane much closer to the ground plane, here a minimum of about 45 inches above the ground. In this position, the user pulls upwardly on the right handle 90*b*, again overcoming the resistance of the selected ones of the incremental weights 151 in the weight stack 150. Such a machine as shown in FIGS. 7, 8 is disclosed in U.S. Patent Publication 20140005009, the disclosure of which is incorporated by reference as if fully set forth herein.

Figure 9:
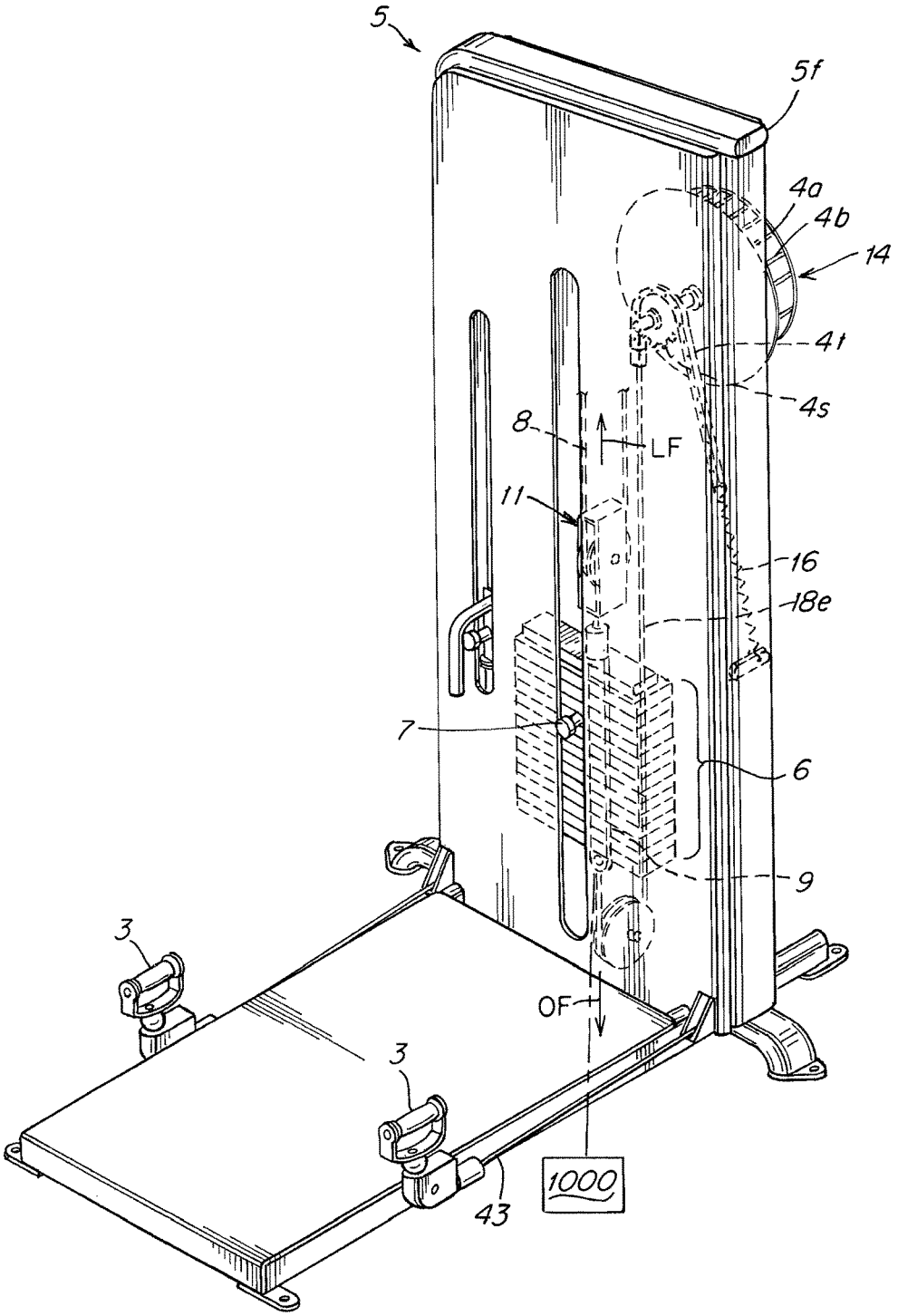
FIG. 9 is front perspective view of another example of an exercise apparatus having a user engageable weight lifting subassembly interconnected to a non-linearly varying resistance mechanism showing the user in an exercise start position.
Figure 10:
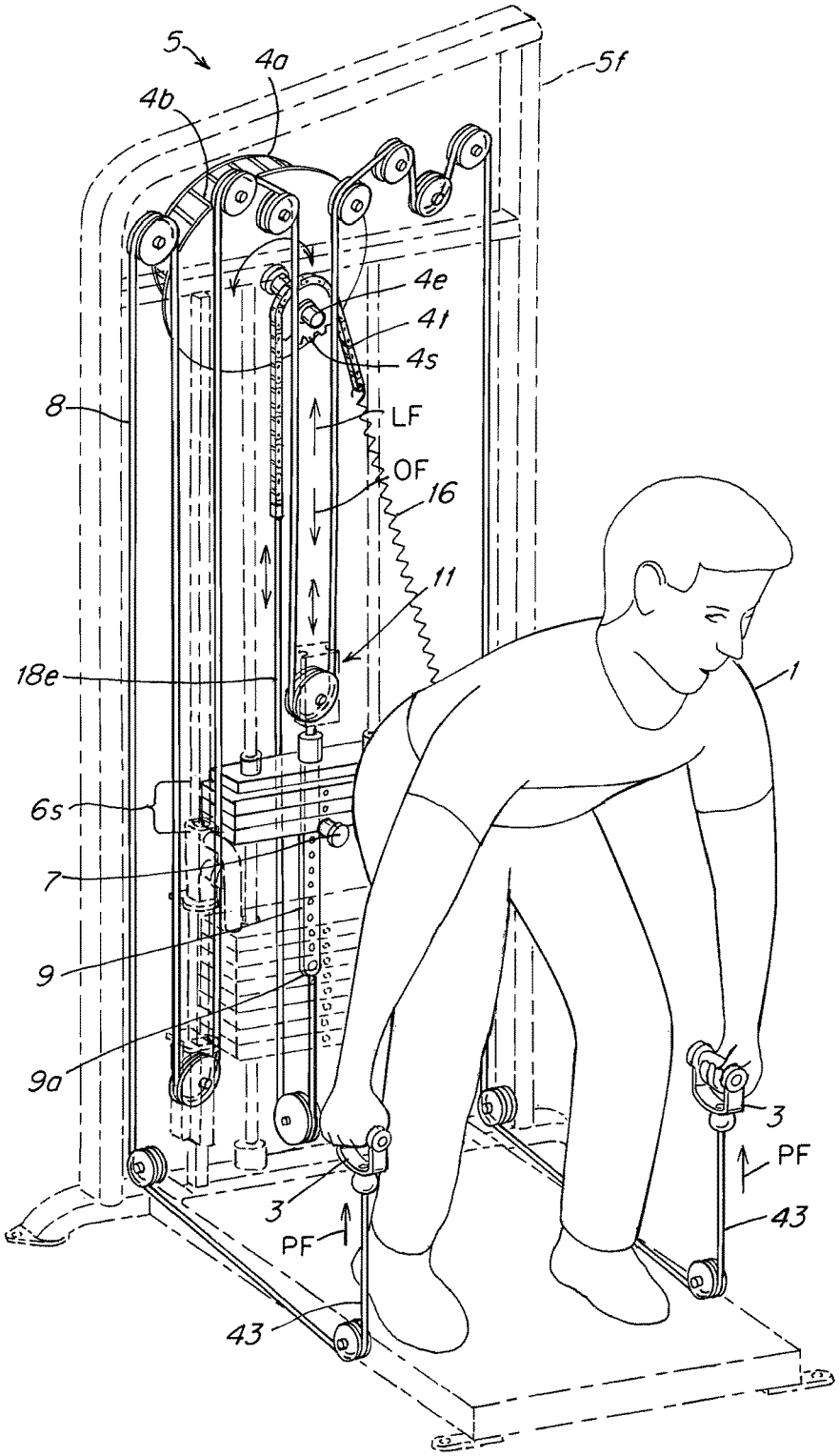
FIG. 10 is a left front view of the apparatus of FIG. 9 showing the user in a subsequent exercise position exerting an exercise force on the weight stack and non-linearly varying force resistance mechanism.

In the machine 5 shown FIGS. 9, 10, a downstream portion 11 of a pull cable 24 is attached at an upstream end 8 to handles 3. The downstream portion 11 is selectively interconnectable via selector pin 7 and rod 9 to a selected number of incremental weights 6*s*. When the user 4*u* exerts a pull force PF on the handles 3, an exercise lifting force LF is exerted via downstream portion 11 of cable 24 on and opposed by the incremental weights 6*s* via the mechanisms shown in FIGS. 9, 10. As in the above described embodiments of FIGS. 1-3, 4-8, the distal end 9*a* of the rod of the FIGS. 8, 10 apparatus is interconnected to a resistance mechanism 1000 that opposes OF the user's lifting force LF in a non-linearly increasing fashion 300, FIG. 3A, relative to the amount of lifting force LF. As in the above embodiments, the resistance mechanism 1000 can comprise a driven wheel assembly 14 having blades 4*b* attached to an axle that impinge on ambient air upon driven rotation R of the wheel 4*a*, the degree of resistance increasing non-linearly 310, FIG. 3B, with increasing speed or rate of rotation SR of the wheel 4*a*. Typically the degree of resistance increases exponentially or geometrically as with the above described embodiments. A machine as shown in FIGS. 9, 10 is described in full in U.S. Pat. No. 8,827,877 the disclosure of which is incorporated herein by reference in its entirety as if fully set forth herein.

Figure 11:
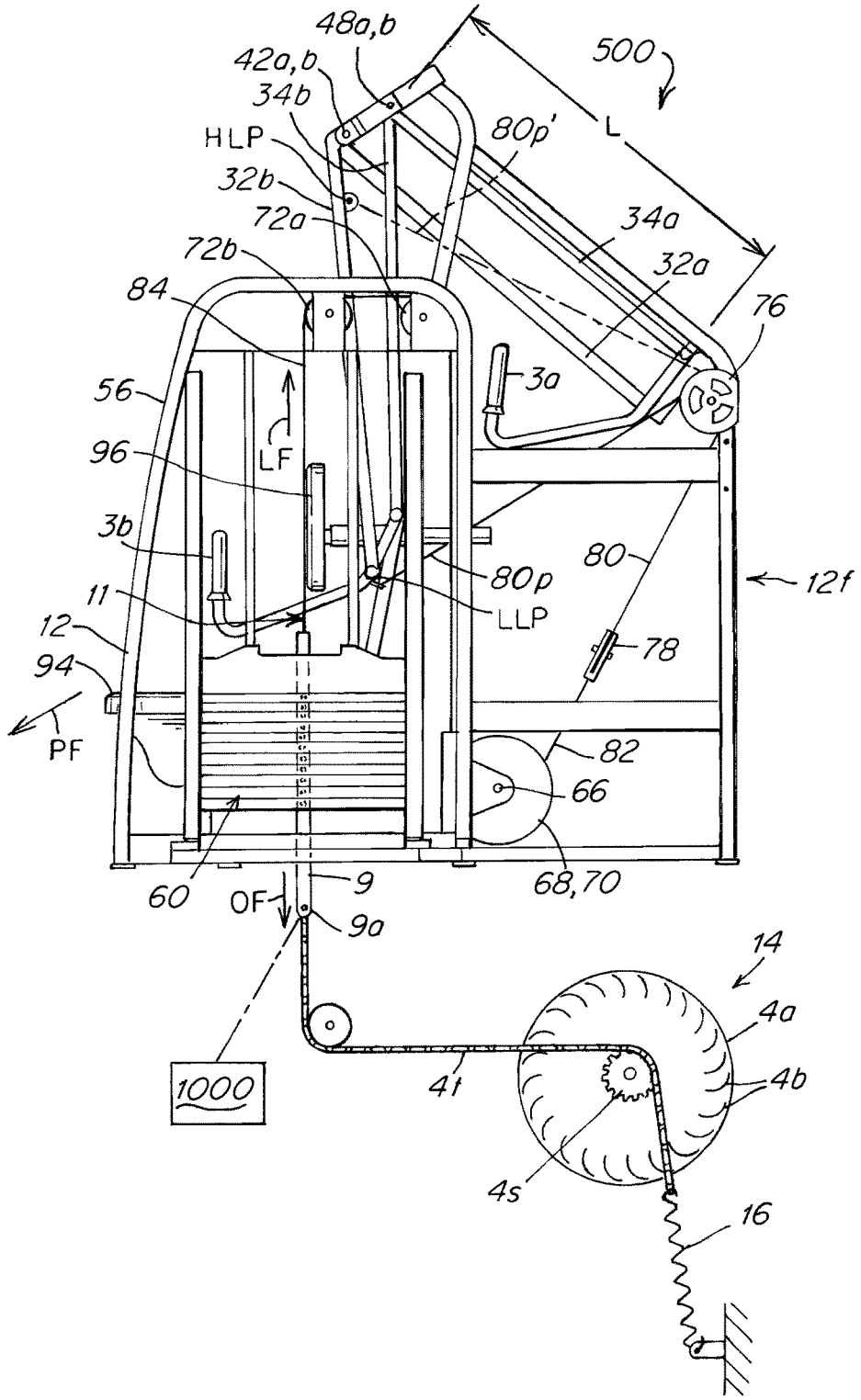
FIG. 11 is a side schematic view of another example of an exercise apparatus having a user engageable weight lifting subassembly interconnected to a non-linearly varying resistance mechanism according to the invention.

In the machine shown in FIG. 11, the handles 38*a* and 38*b* are operably connected to the weight stack 60 via a transmission system. A pair of frame pulleys 76 are mounted to the vertical support of the support frame 12*f*. A lifting pulley 78 is operably connected to the handles 38*a* and 38*b* by a first cable 80, wherein the first cable 80 is threaded about and through the pair of frame pulleys 76, such that the lifting pulley 78 is positioned above the second cam 70. A lifting cable 82 connects the lifting pulley 78 to the second cam 70, where the second cam 70 is caused to rotate when at least one of the handles 38*a* or 38*b* is pulled back. A belt 84 is attached at one end to the first cam 68, extending over the weight stack pulleys 72*a* and 72*b* and attached to the weight stack 60 at the opposite end. As the user pulls back on the handles 38*a* and 38*b*, the lifting pulley 78 is raised, causing the lifting cable 80 to unwind and rotate the second cam 70. As the second cam 70 rotates, the shaft 66 and the first cam 68 rotate as well. The rotation of the first cam 68 pulls the belt 84 over the weight stack pulleys 72*a* and 72*b*, and thus lifts the weight stack 60.

In an exemplary method of operation, a weight is selected on the main weight stack 60 by placing a pin (not shown) in one of the complementary holes, as is known in the art. The user adjusts the seat 20 and chest pad 22 to a suitable position on the front leg. For example, a user with a longer torso will adjust the seat to a lower height such that the handles 38*a* and 38*b* are positioned at a comfortable height parallel with the users shoulders. The chest pad 22 is adjusted such that when the user grasps the handles tension is placed on the lifting cable 80. The user grasps the handles 38*a* and 38*b* and pulls back causing the lifting pulley 78 to be raised. As the lifting pulley 78 is raised, the first cam 70, shaft 66, and second cam 68 rotate, pulling on the belt 84 and lifting the selected weight. The user then returns the handles 38*a* and 38*b* to the initial position, thereby lowering the weight. When the user pulls the handles 38*a* and 38*b* back, the resistance provided by the weight is overcome. When the user returns the handles 38*a* and 38*b*, the user succumbs to the resistance provided by the weight stack 60.

As shown schematically in FIG. 11, the distal end 9*a* of weight bearing rod or manifold 9 is interconnected to a non-linearly varying resistance mechanism 1000 which can increase the amount of force OF exponentially or geometrically with increase of lifting force LF. Mechanism 1000 can take the more specific form of a wheel assembly 14 that exerts resistance OF that varies in a non-linear relationship 300, FIG. 3, with the degree of speed, velocity, force, work or power exerted by the user on a mechanically movable component of the apparatus such as a handle 3, a cable 8 or resistance mechanism or assembly 4*a* et al. The details of a rowing machine 500 as shown in FIG. 11 is disclosed in U.S. Patent Publication No. 20030166439, the disclosure of which is incorporated herein by reference as if fully set forth herein.

In the FIG. 11 machine, a user is typically seated on a bench or seat 94 with the user's chest engaged against a chest pad 96. In the starting position the handles are disposed forwardly of the user in the position where handle 3*a* is disposed as shown in FIG. 11. In performing an exercise, the user pulls on a handle 3*a*, 3*b* so as to cause the handle to travel toward the chest of the user until a handle is pulled to a position such as handle 3*b* is shown as being disposed in FIG. 11. As shown the handles 3*a*, 3*b* are attached to the proximal end of a four bar linkage or lever system, 32*a*, 34*a* near a low leverage point position LLP of one or more of the levers 32*a* or 34*a* or 32*b* or 34*b*. In the FIG. 11 example the proximal end portion 80*p* of the cable 80 is also attached to the lever 32*a* or 34*a* or 32*b* or 34*b* at a position at, near or adjacent the low leverage point or position LLP. In such a configuration when a user pulls on the handle 3*a*, 3*b*, the degree of force PF that the user must exert is relatively high because the cable is attached at a relatively low leverage point LLP of the levers 32*a* or 34*a* or 32*b* or 34*b*. In an alternative embodiment, the proximal end of the cable 80*p*' could be attached to a different position of a lever arm 32*a* or 34*a* or 32*b* or 34*b* which is a relatively high leverage point or position HLP along the length of a lever arm which provides the user with a higher degree of leverage when pulling PF against the weight force of the selected number of individual weights of the weight stack 60 as well as against the non-linearly increasing resistance that is generated by the resistance assembly 14 against the pulling force PF. Thus in the FIG. 11 example the handles 3*a*, 3*b* are not connected directly to the proximal end 80*p* or 80*p*' of the cable 80 but rather are interconnected via a lever arm 32*a* or 34*a* or 32*b* or 34*b* or another bracket or arm that is connected to a lever arm that can be varied in attachment position to vary the degree of force PF that a user must exert to lift a selected number of weights in the stack depending on the precise longitudinal position along the length L of the lever at which the proximal end 80*p*, 80*p*' of the cable 80 is attached.

In the embodiment of FIG. 11, the exercise machine 500 includes a support frame 12. The seat 94 is adapted to be positioned at various heights along the front leg of the frame to provide a comfortable position for users of varying stature. the chest pad 96 is mounted above the seat 20. The chest pad may be adjustable in vertical height such as by means of a telescoping rod held in position by a pin/detent connection. The chest pad 96 is also preferably adjustable at different distances forwardly and backwardly toward a seated user.

The manually movable actuating device for the machine 500 includes four bar linkage mechanisms pivotally mounted at the distal ends to an upper support frame. The four bar linkages are symmetrical in construction and include primary lever arm 32*a*, a secondary lever arm 34*a*, and a handle 38*a*. The primary lever arm 32*a* and secondary lever arm 34*a* lie and travel in a common plane which minimally diverges from a vertical midplane as the primary lever 32*a* and the secondary lever 34*a* are drawn. The divergence of the common plane is sufficient to allow the handles 3*a* and 3*b* to pass on opposite sides of the user. The primary lever arm 32*a* is an elongated bar which is pivotally connected at its proximal end to the handle 3*a*. The distal end of the primary lever arm 32*a* is pivotally connected to the upper support frame 36 by primary axle or pivot point 42*a*. Secondary lever arm 34*a* is similarly an elongated bar which is pivotally connected at its proximal end 8*p* to handle 3*a*, and is pivotally connected at its distal end to the upper support frame by secondary axle 48*a*. The secondary axle or pivot point 48*a*.

The weight stack 60 is mounted on the support frame 12 in a position where the weight stack 60 is easily accessed by a user seated in seat 94. The handles 3*a* and 3*b* are operably connected to the weight stack 60 via the cable 80 and manifold 9. In an exemplary method of operation, a weight is selected on the main weight stack 60 by placing a pin (not shown) in one of the holes, as is known in the art. The user adjusts the seat 94 and chest pad 96 to a suitable position. The chest pad 96 is adjusted such that when the user grasps the handles tension is placed on the lifting cable 80. The user grasps the handles 3*a* and/or 3*b* and pulls back causing the lifting pulley 78 to be raised. As the lifting pulley 78 is raised, the first cam 70, shaft 66, and second cam 68 rotate, pulling on the manifold 9 and lifting the selected weight. The user then returns the handles 3*a* and 3*b* to the initial position, thereby lowering the weight. When the user pulls PF the handles 3*a*, 3*b* the second resistance is also provided by the second resistance assembly 14 via the interconnection of chain 4*t* to the manifold at connection point 9*a*.

What is claimed is:

1. An exercise apparatus comprising:

a weight stack comprised of one or more individual bodies of weight, a flexible elongated cable having a downstream portion that is connected to a manifold that is connected to both a user selectable number of the one or more individual bodies of weight and to a second resistance device, the one or more individual bodies of weight exerting a first resistance and the second resistance device exerting a second resistance, a manually movable actuating device interconnected to a proximal end of the flexible elongated cable, the manually movable actuating device being manually movable by the user to exert an exercise speed, velocity, force, energy or power through the flexible elongated cable to the downstream portion of the flexible elongated cable and the manifold, the manifold pulling via the flexible elongated cable directly against a weight of the one or more individual bodies of weight and against the second resistance device, wherein the second resistance exerted by the second resistance device increasing non-linearly with an increase in the exercise speed, velocity, force, energy or power exerted on the manually movable actuating device by the user, wherein the second force resistance device comprises a wheel having a drivably rotatable axle interconnected to one or more blades that forcibly engage against air on rotation of the drivably rotatable axle, the wheel being interconnected to the downstream portion of the flexible elongated cable in an arrangement wherein the drivably rotatable axle of the wheel is rotatably driven by the exercise speed, velocity, force, energy or power exerted by the user on the manually movable actuating device.

2. The exercise apparatus of claim 1 wherein the drivably rotatable axle of the wheel is spring-load biased against rotation by the exercise speed, velocity, force, energy or power exerted by the user on the manually movable actuating device.

3. The exercise apparatus of claim 1 wherein the second resistance varies non-linearly with a speed of rotation of the wheel.

4. The exercise apparatus of claim 1 wherein the second resistance varies exponentially or geometrically with a speed of rotation of the wheel.

5. An exercise apparatus comprising:

first and second manually movable actuating devices, each being interconnected to first and second cables respectively, the first and second cables being directly connected to first and second weight stacks respectively, each of the first and second weight stacks comprised of first and second sets of one or more individual bodies of weight, the first and second cables each having first and second downstream portions respectively interconnected to the first and second sets of the one or more individual bodies of weight and to third and fourth resistance devices respectively, the first and second sets of one or more individual bodies of weight exerting first and second resistances respectively and the third and fourth resistance devices exerting third and fourth resistances, the first and second manually movable actuating devices being respectively interconnected to first and second proximal ends of the first and second cables, the first and second manually movable actuating devices being manually movable by the user to exert first and second exercise speeds, velocities, forces, energies or powers respectively through the first and second cables to the first and second downstream portions of first and second cables, the first and second downstream portions of the first and second cables respectively pulling directly against a weight of the first and second sets of the one or more individual bodies of weight and against the third and fourth resistance devices, the third and fourth resistances exerted by the third and fourth resistance devices each respectively increasing non-linearly with an increase in the first and second exercise speeds, velocities, forces, energies or powers, respectively exerted on the first and second manually movable actuating devices by the user, wherein the third and fourth resistance devices comprise third and fourth wheels respectively each having a drivably rotatable axle interconnected to one or more blades that forcibly engage against air on rotation of the drivably rotatable axle, the third and fourth wheels being interconnected respectively to the first and second downstream portions of the first and second cables respectively in an arrangement wherein the drivably rotatable axles of the third and fourth wheels are rotatably driven by the first and second exercise speeds, velocities, forces, energies or powers exerted by the user on the first and second manually movable actuating devices.

6. The exercise apparatus of claim 5 wherein the drivably rotatable axles of the third and fourth wheels are spring-load biased against rotation by the first and second exercise speeds, velocities, forces, energies or powers exerted by the user on the first and second manually movable actuating devices.

7. The exercise apparatus of claim 5 wherein the third and fourth resistances varies non-linearly with a speed of rotation of the third and fourth wheels, respectively.

8. The exercise apparatus of claim 5 wherein the third and fourth resistances varies exponentially or geometrically with a speed of rotation of the third and fourth wheels respectively.

9. The exercise apparatus of claim 5 wherein the first and second downstream portions of the first and second cables are directly connected to first and second manifolds respectively that are directly connectable to a selectable number of the individual bodies of weight of the first and second sets of individual bodies of weight respectively.

* * * * *